US011627780B2

(12) United States Patent
Strek

(10) Patent No.: US 11,627,780 B2
(45) Date of Patent: Apr. 18, 2023

(54) SOLE STRUCTURE FOR ARTICLE OF FOOTWEAR

(71) Applicant: NIKE, Inc., Beaverton, OR (US)

(72) Inventor: Kyle Strek, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 16/887,395

(22) Filed: May 29, 2020

(65) Prior Publication Data

US 2020/0375320 A1 Dec. 3, 2020

Related U.S. Application Data

(60) Provisional application No. 62/855,356, filed on May 31, 2019.

(51) Int. Cl.

| | |
|---|---|
| ***A43C 15/16*** | (2006.01) |
| ***A43B 13/22*** | (2006.01) |
| *A43B 5/02* | (2006.01) |

(52) U.S. Cl.

CPC ..... *A43C 15/162* (2013.01); *A43B 13/223* (2013.01); *A43C 15/161* (2013.01); *A43B 5/025* (2013.01)

(58) Field of Classification Search

CPC ..... A43B 13/223; A43B 5/001; A43C 15/16; A43C 15/161; A43C 15/165; A43C 15/167

See application file for complete search history.

(56) References Cited

U.S. PATENT DOCUMENTS

| | | | | |
|---|---|---|---|---|
| 3,818,617 A * | 6/1974 | Dassler | A43B 5/06 36/32 R |
| 4,173,083 A * | 11/1979 | Infusino | A43B 5/02 36/128 |
| 4,507,879 A | 4/1985 | Dassler | |
| 4,641,438 A * | 2/1987 | Laird | A43B 13/223 36/32 R |
| 4,670,997 A * | 6/1987 | Beekman | A43B 13/223 36/114 |

(Continued)

FOREIGN PATENT DOCUMENTS

| | | |
|---|---|---|
| CN | 101756419 A | 6/2010 |
| CN | 103987289 A | 8/2014 |

(Continued)

OTHER PUBLICATIONS

European Patent Office (ISA), International Search Report and Written Opinion for PCT Application No. PCT/US2020/035155, dated Sep. 24, 2020.

*Primary Examiner* — Megan E Lynch

(74) *Attorney, Agent, or Firm* — Bookoff McAndrews, PLLC

(57) ABSTRACT

An article of footwear is provided and includes an upper having a bottom surface and a first plate attached to the bottom surface of the upper in a forefoot region. The first plate includes a lateral peripheral cleat disposed adjacent to a first outward-most portion of the upper on a lateral side and a medial peripheral cleat disposed adjacent to a second outward-most portion of the upper on a medial side, the medial peripheral cleat being disposed closer to an anterior end of the first plate than the lateral peripheral cleat.

20 Claims, 11 Drawing Sheets

(56) References Cited

U.S. PATENT DOCUMENTS 4,742,626 A * 5/1988 Tadiotto ..... A43B 13/223 36/127
4,914,838 A * 4/1990 Ihlenburg ..... A43B 13/141 36/102
5,077,916 A * 1/1992 Beneteau ..... A43B 5/02 361/114
5,461,801 A * 10/1995 Anderton ..... A43B 3/0052 24/713.4
5,862,614 A * 1/1999 Koh ..... A43B 13/223 36/31
6,705,027 B1 * 3/2004 Campbell ..... A43B 5/001 36/127
6,857,205 B1 2/2005 Fusco et al.
10,244,815 B2 4/2019 Baucom et al.
2002/0004999 A1 * 1/2002 Caine ..... A43B 13/186 36/129
2002/0184793 A1 * 12/2002 Sato ..... A43B 13/12 36/30 R
2003/0019127 A1 * 1/2003 Parisotto ..... A43B 13/223 36/25 R
2003/0093922 A1 * 5/2003 Delgorgue ..... A43B 13/223 36/59 R
2004/0000075 A1 1/2004 Auger et al.
2004/0181974 A1 * 9/2004 Robinson, Jr. ..... A43B 19/00 36/100
2005/0097783 A1 5/2005 Mills et al.
2006/0130361 A1 * 6/2006 Robinson, Jr. ..... A43B 23/24 36/25 R
2006/0150442 A1 7/2006 Auger et al.
2007/0079530 A1 * 4/2007 Fusco ..... A43B 13/223 36/129
2008/0098624 A1 * 5/2008 Goldman ..... A43C 15/16 36/126
2008/0282579 A1 * 11/2008 Bobbett ..... A43B 13/026 36/127
2009/0100716 A1 * 4/2009 Gerber ..... A43B 13/223 36/114
2009/0100718 A1 * 4/2009 Gerber ..... A43B 13/145 36/128
2009/0211118 A1 * 8/2009 Krikorian ..... A43C 15/165 36/134
2010/0154258 A1 6/2010 Scholz et al.
2010/0251578 A1 * 10/2010 Auger ..... A43B 13/223 36/67 A
2012/0227289 A1 9/2012 Beers et al.
2013/0067774 A1 * 3/2013 Auger ..... A43B 13/141 36/103
2013/0067778 A1 * 3/2013 Minami ..... A43C 15/167 36/59 R
2013/0333248 A1 * 12/2013 Auger ..... A43B 3/0052 36/134
2014/0123522 A1 * 5/2014 Rustam ..... A43B 7/144 36/127
2014/0202042 A1 * 7/2014 Berend ..... A43C 13/04 36/25 R
2014/0215853 A1 * 8/2014 Rushbrook ..... A43B 13/22 36/102
2015/0096195 A1 * 4/2015 Bacon ..... A43B 13/141 36/87
2015/0181977 A1 * 7/2015 Klug ..... A43C 15/167 36/134
2015/0189947 A1 * 7/2015 Klug ..... A43C 1/04 36/103
2015/0359294 A1 * 12/2015 VanHook ..... A43B 13/223 36/25 R
2016/0021977 A1 * 1/2016 Madore ..... A43B 5/001 36/30 R
2016/0051011 A1 * 2/2016 Francis ..... A43B 5/00 36/59 C
2016/0073733 A1 * 3/2016 Auger ..... A43B 13/223 36/59 R
2016/0157557 A1 * 6/2016 Cross ..... A43B 13/184 36/25 R
2016/0242499 A1 * 8/2016 Droege ..... A43B 13/181
2017/0055634 A1 * 3/2017 Baucom ..... A43B 5/06
2017/0127755 A1 * 5/2017 Bunnell ..... A43B 13/188
2017/0202301 A1 * 7/2017 Amis ..... A43B 5/02
2018/0084862 A1 * 3/2018 Bacon ..... A43B 13/141
2018/0242688 A1 * 8/2018 Madore ..... A43B 5/001
2019/0090585 A1 * 3/2019 Loveder ..... A43B 13/122
2019/0104806 A1 * 4/2019 Cass ..... B32B 9/025
2019/0313734 A1 * 10/2019 Bartel ..... A43B 13/12

FOREIGN PATENT DOCUMENTS

CN 104684427 A 6/2015
CN 104936476 A 9/2015
CN 108601422 A 9/2018
WO WO-2014155707 A1 * 10/2014 ..... A43B 5/02

* cited by examiner

SOLE STRUCTURE FOR ARTICLE OF FOOTWEAR

CROSS REFERENCE TO RELATED APPLICATIONS

This non-provisional U.S. Patent Application claims priority under 35 U.S.C. § 119(e) to U.S. Provisional Patent Application Ser. No. 62/855,356, filed May 31, 2019, the disclosure of which is hereby incorporated by reference in its entirety.

FIELD

The present disclosure relates generally to sole structures for articles of footwear and more particularly to sole structures incorporating traction elements.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. The outsole may include one or more traction elements or cleats for engaging a ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
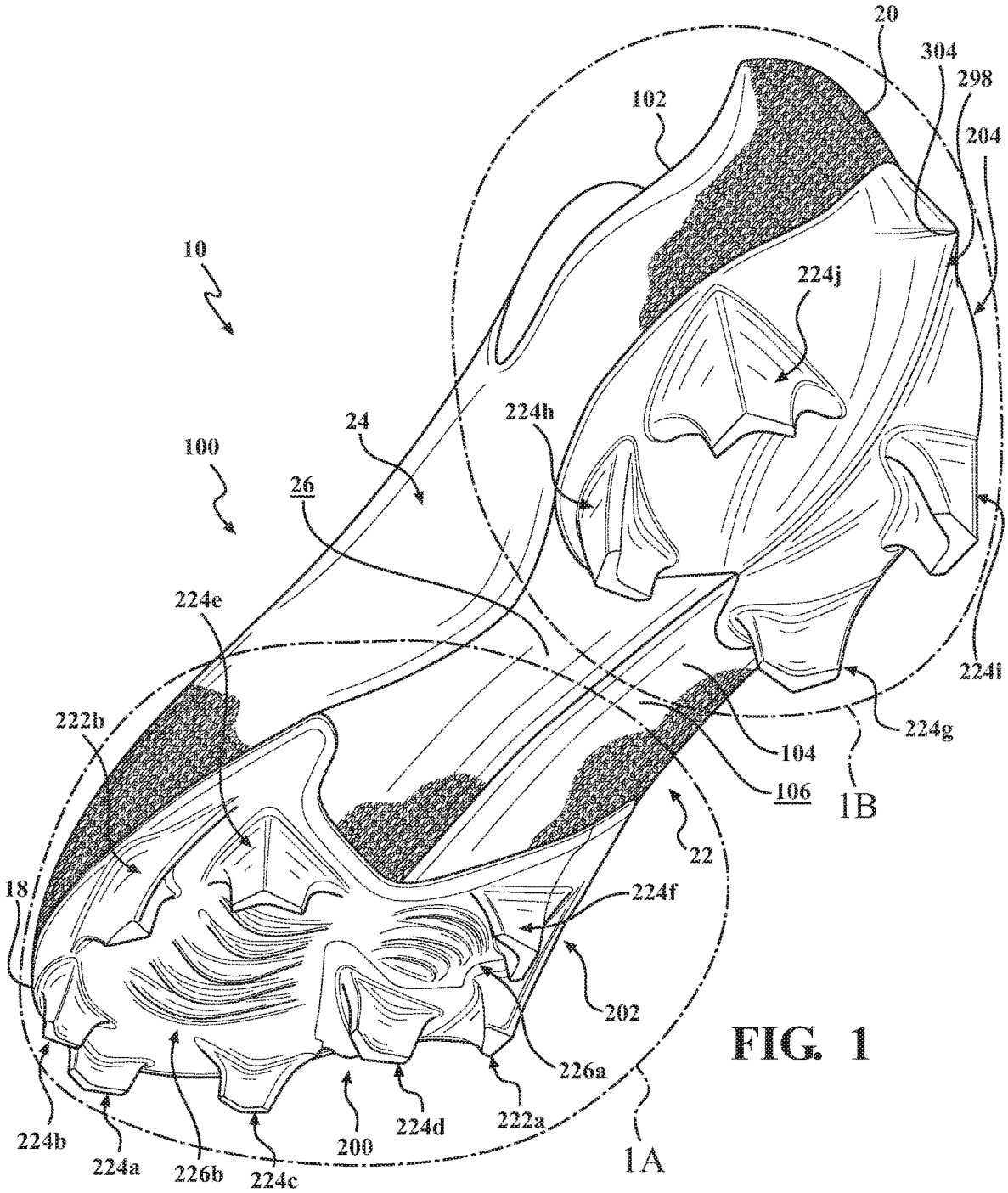
FIG. 1 is a bottom perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an article of footwear is provided and includes an upper having a bottom surface and a first plate attached to the bottom surface of the upper in a forefoot region. The first plate includes a lateral peripheral cleat disposed adjacent to a first outward-most portion of the upper on a lateral side and a medial peripheral cleat disposed adjacent to a second outward-most portion of the upper on a medial side, the medial peripheral cleat being disposed closer to an anterior end of the first plate than the lateral peripheral cleat.

In one configuration, the first outward-most portion of the upper and the second outward-most portion of the upper may be aligned along a metatarsophalangeal axis. Additionally or alternatively, each of the peripheral cleats may include a stud disposed at the respective outward-most portion of the upper, a first blade extending along a first longitudinal direction from an anterior end of the stud, and a second blade extending along a second longitudinal direction from a posterior end of the stud. Optionally, the stud may include an outward-facing surface disposed adjacent to a peripheral surface of the first plate.

The first plate may include one or more serrated regions. The one or more serrated regions may include a first serrated region disposed on the lateral side of the first plate and a second serrated region disposed on the medial side of the first plate. Additionally or alternatively, each of the one or more serrated regions may include a plurality of arcuate ribs.

In one configuration, a second plate may be disposed in a heel region. Further, the first plate may include a plurality of directional cleats. Each of the directional cleats may include a first leg and a second leg.

In another configuration, an article of footwear is provided and includes an upper having a bottom surface and a first plate attached to the bottom surface of the upper in a forefoot region. The first plate includes a first peripheral cleat disposed adjacent to a peripheral side surface on a lateral side and a second peripheral cleat disposed adjacent to the peripheral side surface on a medial side, each of the first peripheral cleat and the second peripheral cleat (i) including a central stud and at least one blade extending in a longitudinal direction along the peripheral side surface of the first plate and (ii) being offset from one another along a longitudinal axis of the first plate.

In one configuration, the central stud and the at least one blade of the first peripheral cleat may cooperate to form a first continuous outer surface adjacent to the peripheral side surface on the lateral side, and the central stud and the at least one blade of the second peripheral cleat may cooperate to form a second continuous outer surface adjacent to the peripheral side surface on the medial side.

The at least one blade may include a first blade extending along a first longitudinal direction from an anterior end of the central stud, and a second blade extending along a second longitudinal direction from a posterior end of the central stud. The central stud may include an outward-facing surface disposed adjacent to a peripheral surface of the first plate.

In one configuration, the first plate may include one or more serrated regions. The one or more serrated regions may include a first serrated region disposed on the lateral side of the first plate and a second serrated region disposed on the medial side of the first plate. Each of the one or more serrated regions may include a plurality of arcuate ribs.

A second plate may be disposed in a heel region. Further, the first plate may include a plurality of directional cleats. Each of the directional cleats may include a first leg and a second leg.

Figure 2:
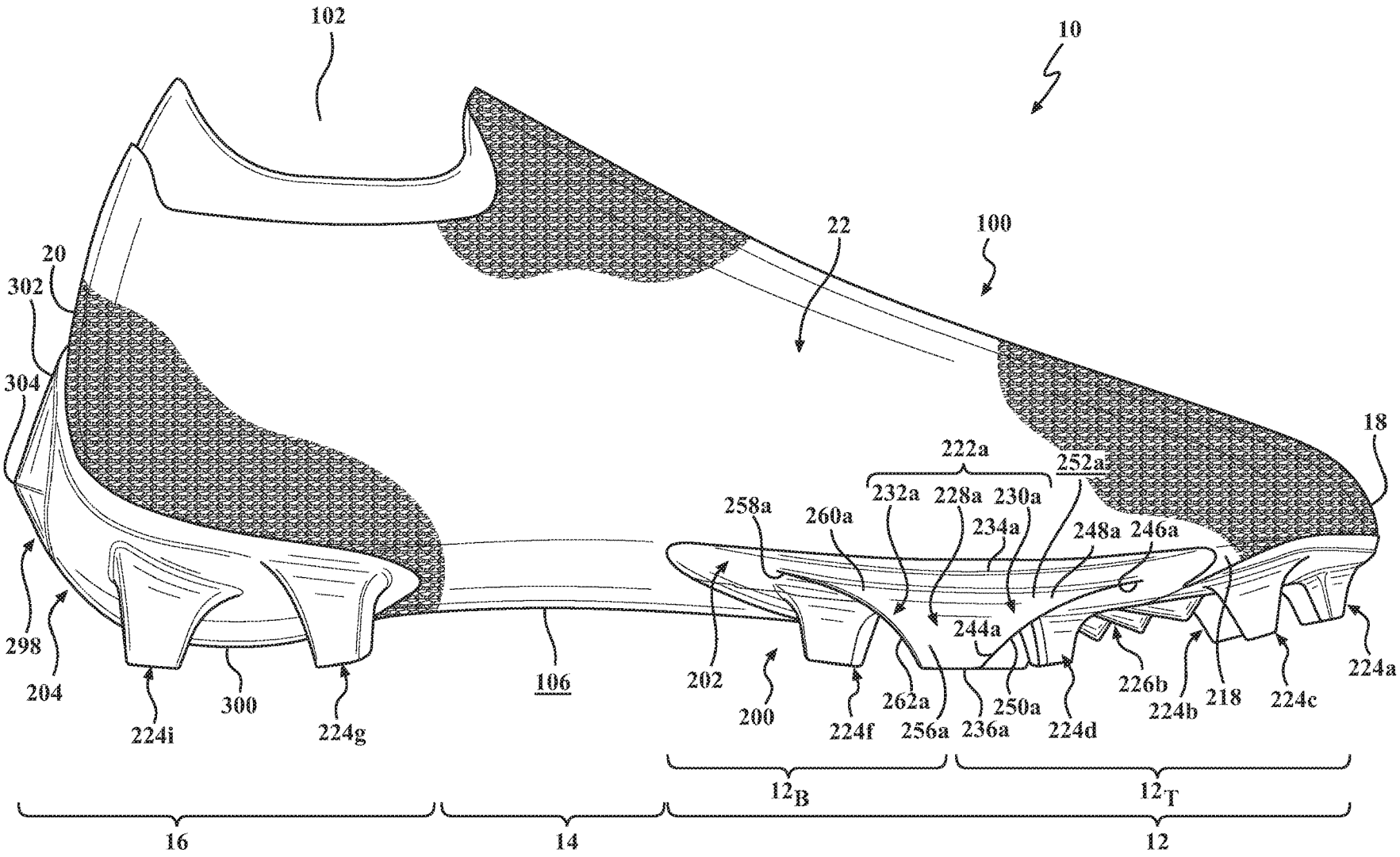
FIG. 2 is a lateral side elevation view of the article of footwear of FIG. 1.
Figure 3:
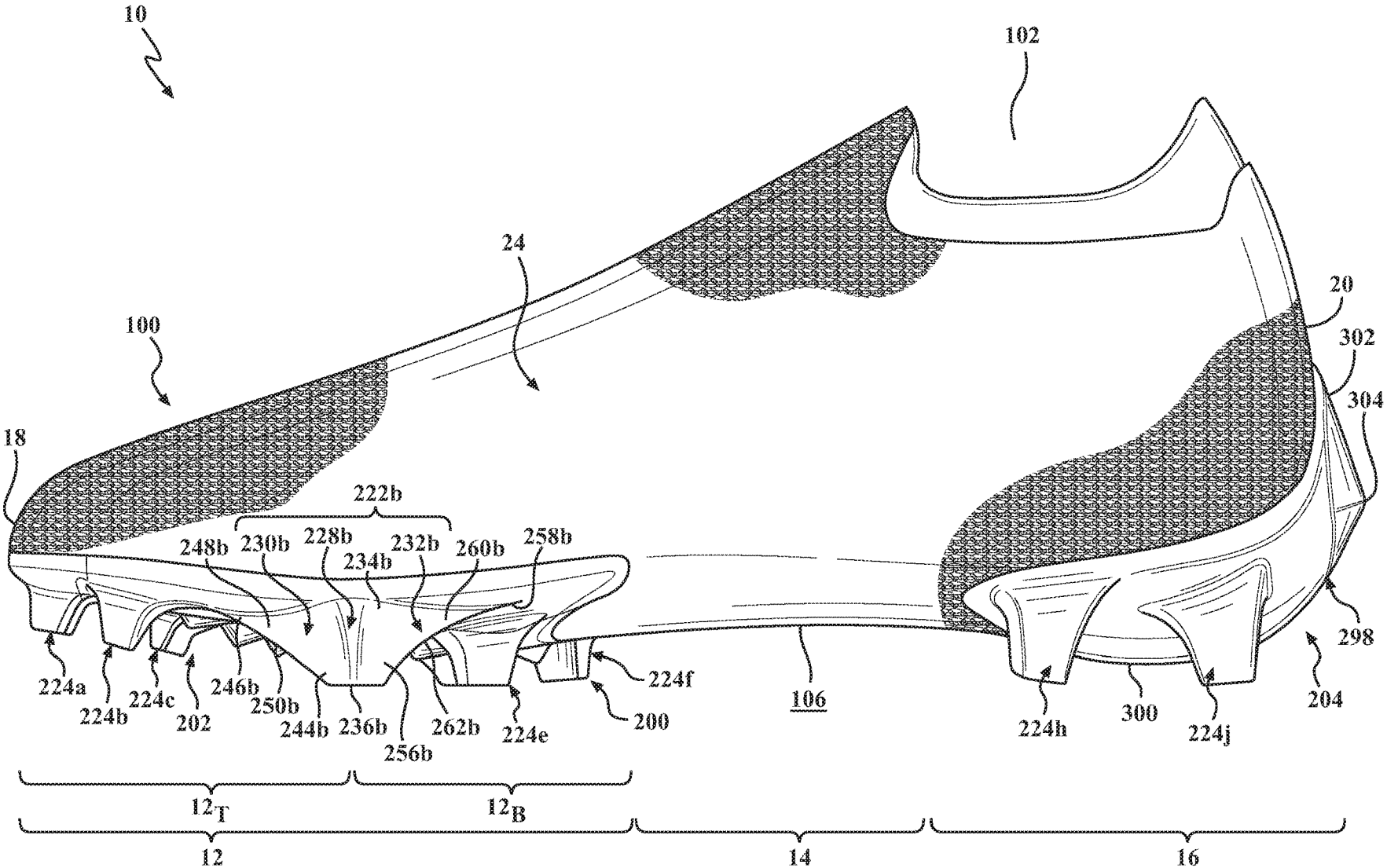
FIG. 3 is a medial side elevation view of the article of footwear of FIG. 1.
Figure 4:
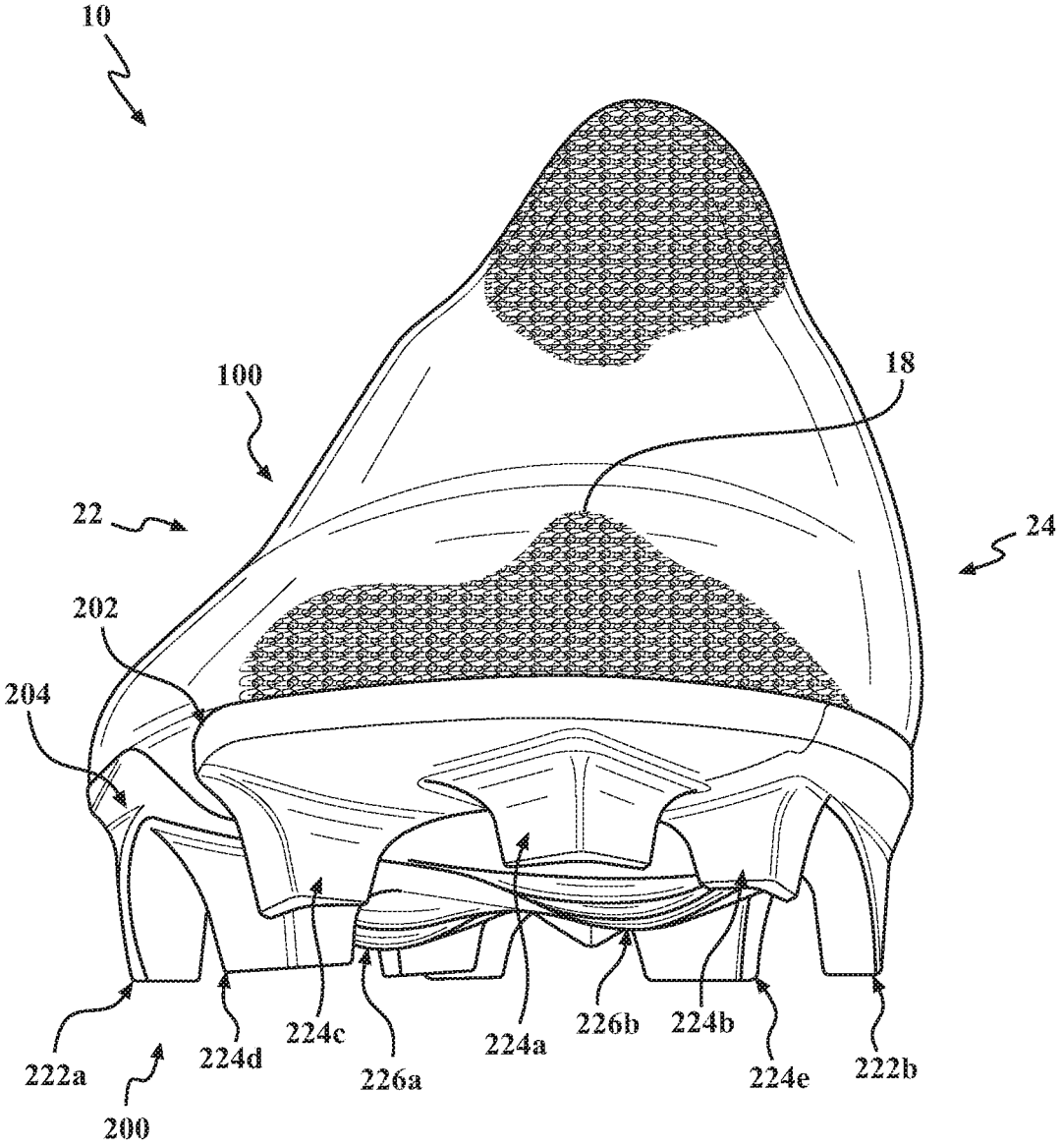
FIG. 4 is a front elevation view of the article of footwear of FIG. 1.
Figure 5:
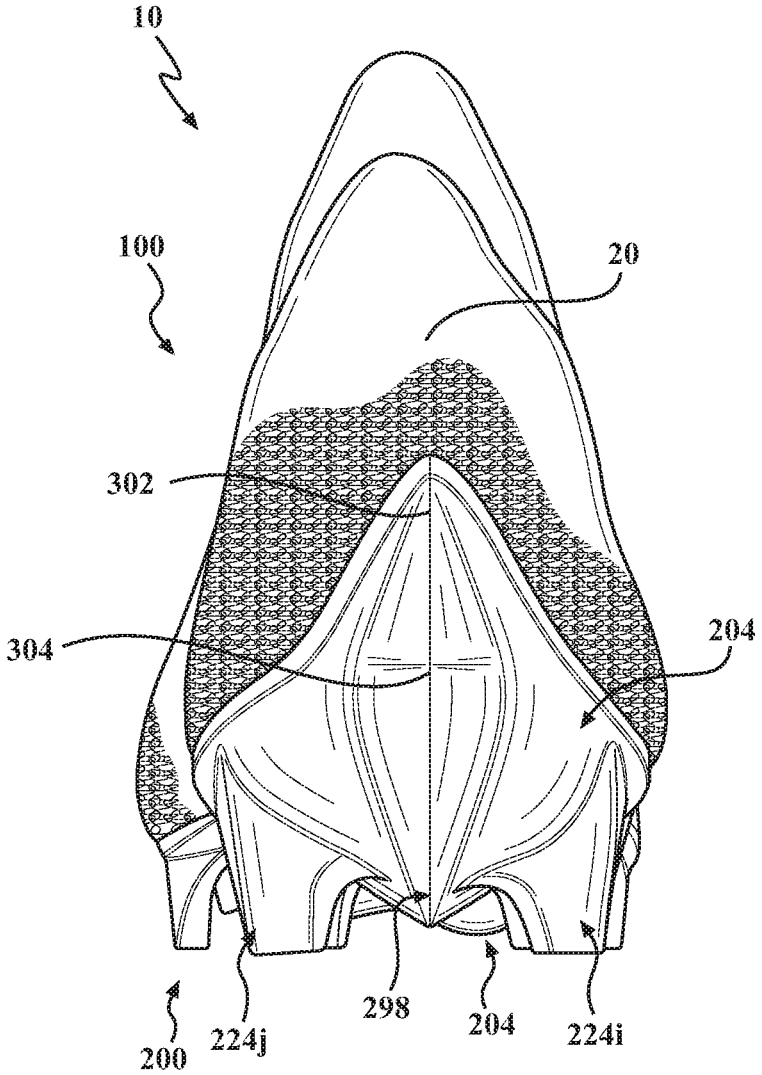
FIG. 5 is a rear elevation view of the article of footwear of FIG. 1.

Referring to FIGS. 1-3, an article of footwear 10 includes an upper 100 and a sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. A metatarsophalangeal (MTP) axis AMTP extends laterally across the article 10 along the intersection of the toe portion 12T and the ball portion 12B, and corresponds to an MTP joint of the foot. Accordingly, the article of footwear 10 is widest across the MTP axis AMTP. Put another way, outward-most portions of the article of footwear 10 are disposed on the MTP axis AMTP. The mid-foot region 14 may correspond with an arch area of the foot, and the heel region 16 may correspond with rear portions of the foot, including a calcaneus bone.

Figure 6:
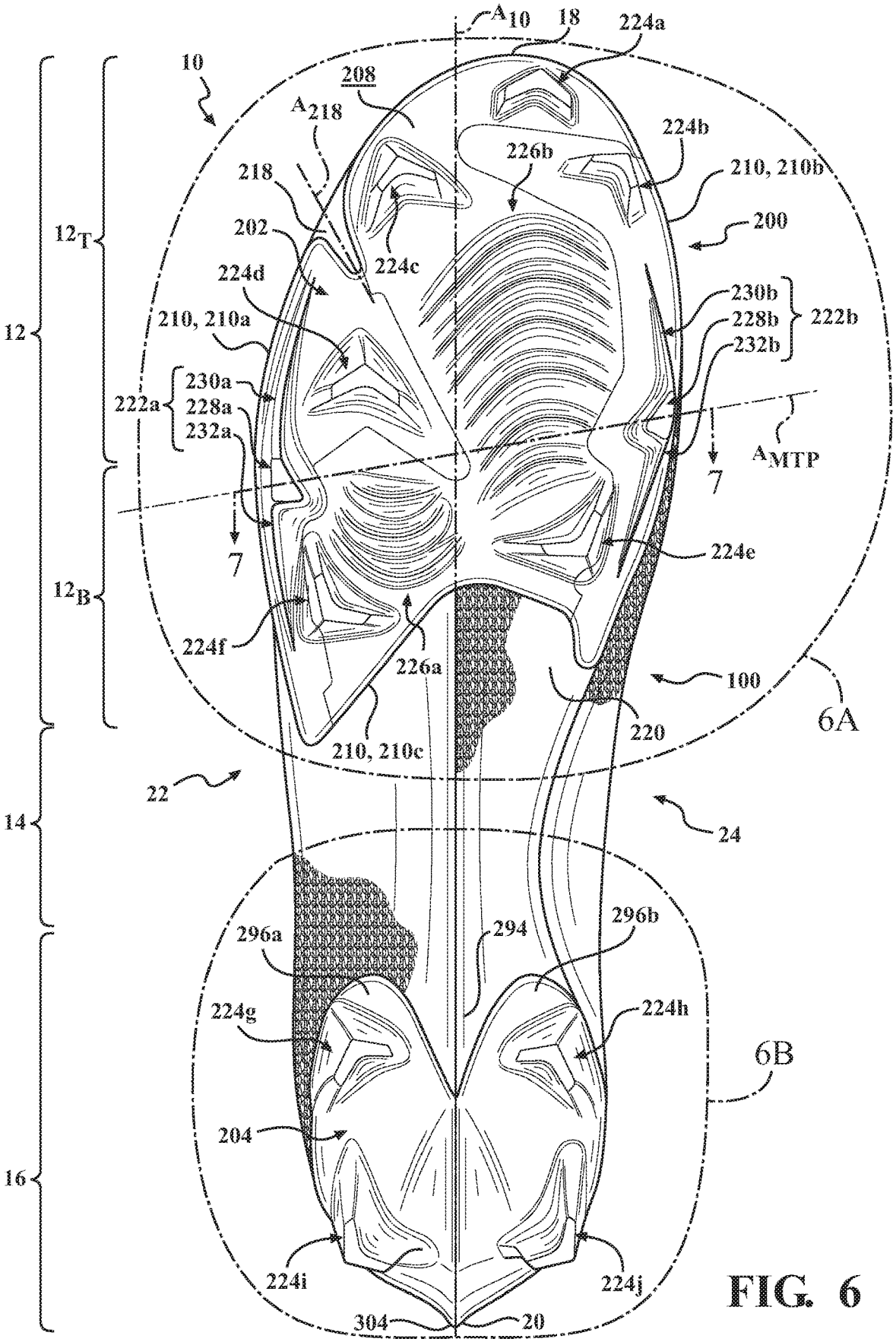
FIG. 6 is a bottom plan view of the article of footwear of FIG. 1.

The footwear 10 may further include an anterior end 18 associated with a forward-most point of the forefoot region 12, and a posterior end 20 corresponding to a rearward-most point of the heel region 16. As shown in FIG. 6, a longitudinal axis $A_{10}$ of the footwear 10 extends along a length of the footwear 10 from the anterior end 18 to the posterior end 20, parallel to a ground surface. The longitudinal axis $A_{10}$ is centrally located along the length of the footwear 10, and generally divides the footwear 10 into a lateral side 22 and a medial side 24. Accordingly, the lateral side 22 and the medial side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the lateral side 22 to the medial side 24.

The upper 100 includes interior surfaces that define an interior void 102 configured to receive and secure a foot for support on the sole structure 200. An ankle opening in the heel region 16 may provide access to the interior void 102. For example, the ankle opening may receive a foot to secure the foot within the void 102 and to facilitate entry and removal of the foot from and to the interior void 102. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 7:
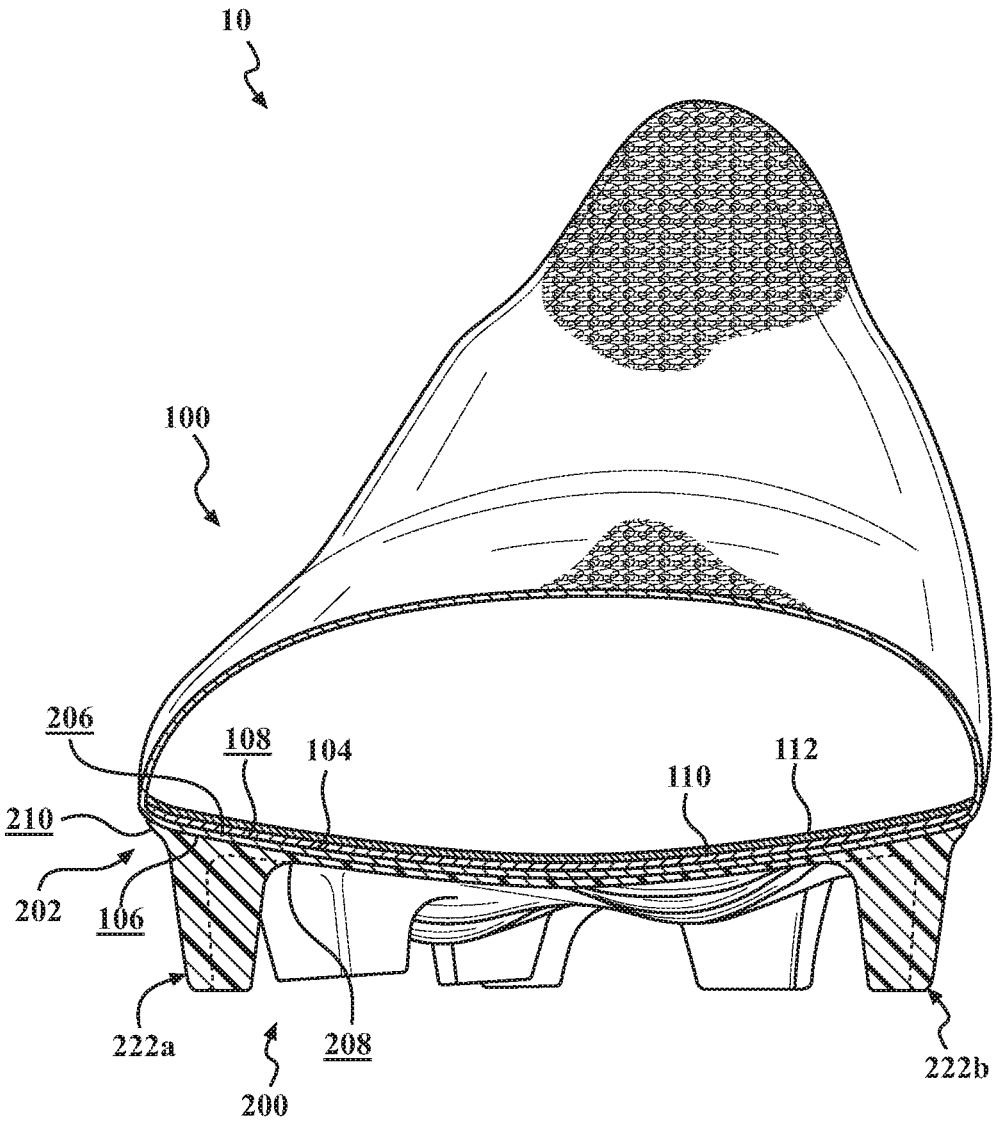
FIG. 7 is a cross-sectional view of the article of footwear of FIG. 1, taken along section line 7-7 in FIG. 6.

With reference to FIG. 7, in some examples the upper 100 includes a strobel 104 having a bottom surface 106 opposing the sole structure 200 and an opposing top surface 108 defining a footbed of the interior void 102. In some examples, the strobel 104 is attached to the upper 100 using stitching or adhesives. In the illustrated example, the upper 100 is formed as a unitary boot or sock, wherein the strobel 104 and the upper 100 are unitarily formed of a knitted material. The footbed defined by the top surface 108 may be contoured to conform to a profile of the bottom surface (e.g., plantar) of the foot. Optionally, the upper 100 may also incorporate additional layers such as one or more support plates 110, and an insole 112 or sockliner that may be disposed upon the strobel 104 and reside within the interior void 102 of the upper 100 to receive a plantar surface of the foot to enhance the comfort of the article of footwear 10.

In some examples, one or more fasteners extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners. The fasteners may include laces, straps, cords, hook-and-loop, or any other suitable type of fastener. The upper 100 may include a tongue portion that extends between the interior void 102 and the fasteners.

With continued reference to FIG. 1, the sole structure 200 is attached to the bottom surface 106 of the strobel 104 and includes a forefoot plate 202 disposed in the forefoot region 12 and a separate heel plate 204 disposed in the heel region 16. Accordingly, the mid-foot region 14 of the strobel 104 may be exposed between the forefoot plate 202 and the heel plate 204. As described in greater detail below, the forefoot plate 202 and the heel plate 204 each include a plurality of ground-engaging members, which are configured to engage a soft or resilient ground surface. Each of the forefoot plate 202 and the heel plate 204 are formed of one or more rigid or semi-rigid materials. In some examples, the forefoot plate 202 and the heel plate 204 are formed of one or more polymeric materials. In other examples, one or both of the forefoot plate 202 and the heel plate 204 may include a composite material, such as a fiber-reinforced composite material.

The forefoot plate 202 includes a top surface 206 (FIG. 7) attached to the bottom surface 106 of the upper 100, a bottom surface 208 formed on an opposite side of the forefoot plate 202 from the top surface 206, and a peripheral side surface 210 extending between the top surface 206 and the bottom surface 208 and defining an outer peripheral profile of the forefoot plate 202. Likewise, the heel plate 204 includes a top surface (not shown) attached to the bottom surface 106 of the upper 100, a bottom surface 214 formed on an opposite side of the forefoot plate 202 from the top surface, and a peripheral side surface 216 extending between the top surface and the bottom surface 208 and defining an outer peripheral profile of the heel plate 204. As discussed above, the forefoot plate 202 and the heel plate 204 are spaced apart from each other in the midfoot region 14 such that the bottom surface 106 of the upper 100 is exposed through the mid-foot region 14. Accordingly, the bottom surface 208 of the forefoot plate 202, the bottom surface 106 of the upper 100, and the bottom surface 214 of the heel plate 204 cooperate to define a ground-engaging surface 26 of the article of footwear 10.

As best shown in FIG. 6, the peripheral side surface 210 of the forefoot plate 202 includes a lateral portion 210*a* extending along the lateral side 22 of the upper 100 from the mid-foot region 14 to the anterior end 18, a medial portion 210*b* extending along the medial side 24 of the upper from the mid-foot region 14 to the anterior end 18, and a mid-foot portion 210*c* connecting the lateral portion 210*a* and the medial portion 210*b* across the mid-foot region 14.

In some examples, the lateral portion 210*a* of the peripheral side surface 210 may define a notch 218 on the lateral side 22 of the forefoot plate 202. The notch 218 is disposed in the toe portion 12T, intermediate the MTP axis AMTP and the anterior end 18. In some instances, the notch 218 extends inwardly from the lateral side 22 along a notch axis $A_{218}$ formed at an oblique angle with respect to the longitudinal axis $A_{10}$ of the footwear 10. As shown, the longitudinal axis $A_{218}$ extends inwardly and towards the posterior end 20 of the footwear 10. Optionally, a width of the notch 218 may be tapered along the direction of the notch axis $A_{218}$.

The mid-foot portion 210*c* of the peripheral side surface 210 may form a cut-out 220 at a posterior end of the forefoot plate 202, between the lateral portion 210*a* and the medial portion 210*b*. As shown, the cut-out 220 has a polygonal shape defined by a plurality of straight segments of the mid-foot portion 210*c*. In other examples, the cut-out 220 may be arcuate, or a combination of arcuate and polygonal.

The bottom surface 208 of the forefoot plate 202 includes a plurality of traction elements including a pair of peripheral traction elements 222*a*, 222*b* and one or more directional traction elements 224*a*-224*f* In some examples, the forefoot plate 202 may further include at least one serrated region 226*a*, 226*b* formed in an interior portion of the bottom surface 208.

The peripheral traction elements 222*a*, 222*b* include a lateral peripheral traction element 222*a* disposed adjacent to an outward-most portion of the article of footwear 10 on the lateral side 22, and a medial peripheral traction element 222*b* disposed adjacent to an outward-most portion of the article of footwear 10 on the medial side 22. Accordingly, the lateral peripheral traction element 222*a* and the medial peripheral traction element 222*b* are aligned with each other along the MTP axis $A_{218}$, such that the peripheral traction elements 222*a*, 222*b* are disposed on opposite sides of the widest portion of the footwear 10. Thus, the lateral peripheral traction element 222*a* is disposed adjacent to an outward-most portion of the upper 100 on the lateral side 22 of the forefoot plate 202, while the medial peripheral traction element 222*b* is disposed adjacent to an outward-most portion of the upper 100 on the medial side 24 of the forefoot plate 202. The medial peripheral traction element 222*b* may be offset from the lateral peripheral traction element 222*a* along the longitudinal axis $A_{10}$ such that the medial peripheral traction element 222*b* is disposed closer to the anterior end 18 than the lateral peripheral traction element 222*a*, as shown in FIG. 6.

Each of the peripheral traction elements 222*a*, 222*b* includes a central stud 228*a*, 228*b*, an anterior blade 230*a*, 230*b* extending from the central stud 228*a*, 228*b* towards the anterior end 18, and a posterior blade 232*a*, 230*b* extending in an opposite direction from the central stud 228*a*, 228*b* towards the posterior end 20. The central stud 228*a*, 228*b* extends from a proximal end 234*a*, 234*b* attached to the bottom surface 208 to a terminal, distal end 236*a*, 236*b* facing away from the bottom surface 208.

In the illustrated example, each of the central studs 228*a*, 228*b* includes an outer surface 238*a*, 238*b*, a posterior surface 240*a*, 240*b*, and an inner surface 242*a*, 242*b* that cooperate to define a substantially triangular cross-sectional shape of each of the central studs 228*a*, 228*b*. One or both of the central studs 228*a*, 228*b* may taper along a direction from the proximal end 234*a*, 234*b* to the distal end 236*a*, 236*b*, whereby a cross-sectional area of the distal end 236*a*, 236*b* is less than a cross-sectional area of the proximal end 234*a*, 234*b*. The outer surfaces 238*a*, 238*b* of each of the studs 228*a*, 228*b* extend from the peripheral side surface 210 of the forefoot plate 202 such that the central studs 228*a*, 228*b* form a portion of the outer peripheral of the forefoot plate 202. Optionally, the posterior surface 232*b* of the central stud 228*b* on the medial side 24 may be concave, while the posterior surface 232*a* of the central stud 228*a* on the lateral side 22 is substantially planar.

Figure 6A:
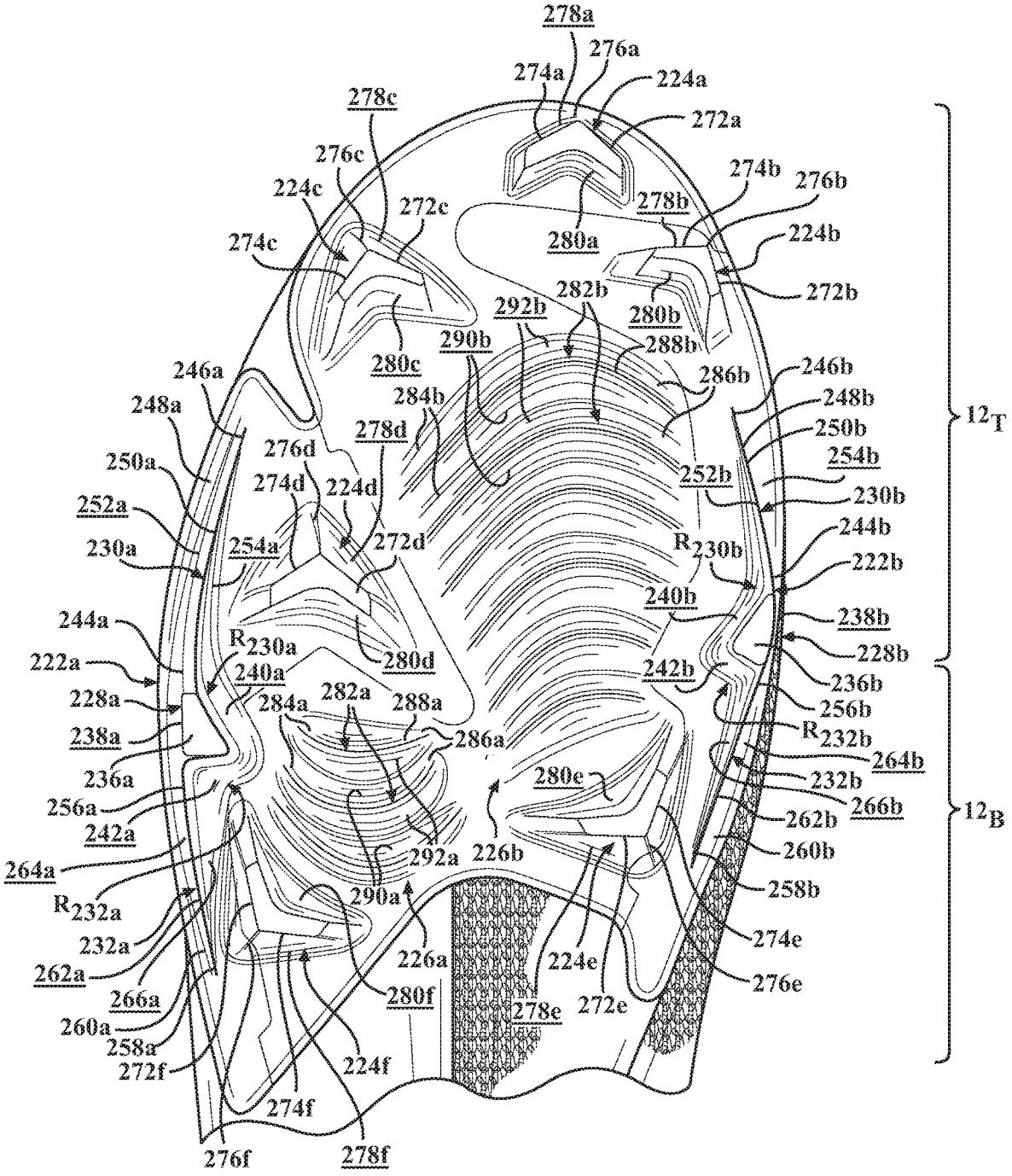
FIG. 6A is an enlarged bottom plan view of the article of footwear of FIG. 1, taken at area 6A of FIG. 6.

As best shown in FIG. 6A, each of the anterior blades 230*a*, 230*b* includes a first end 244*a*, 244*b* attached to an anterior end of the central stud 228*a*, 228*b* and a terminal end 246*a*, 246*b* disposed between the central stud 228*a*, 228*b* and the anterior end 18. Accordingly, a length of each of the anterior blades 230*a*, 230*b* extends from the first end 244*a*, 244*b* at the central stud 228, and towards the anterior end 18 of the article of footwear 10 to the terminal end 246*a*, 246*b*.

A height of the anterior blades 230*a*, 230*b* extends from a base 248*a*, 248*b* attached to the bottom surface 208 of the forefoot plate 202 to a distal edge 250*a*, 250*b* facing away from the bottom surface 208. As shown in FIGS. 2 and 3, the heights of the anterior blades 230*a*, 230*b* taper along the lengthwise direction of each of the anterior blades 230*a*, 230*b*, from the first end 244*a*, 244*b* to the terminal end 246*a*, 246*b*. In some examples, the distal edge 250*a*, 250*b* may have a concave profile from the first end 244*a*, 244*b* to the terminal end 246*a*, 246*b*.

In the illustrated example, each of the anterior blades 230*a*, 230*b* includes an outer surface 252*a*, 252*b* facing an outer periphery of the article 10, and an inner surface 254*a*, 254*b* formed on an opposite side of the anterior blade 230*a*, 230*b* from the outer surface 252*a*, 252*b*. The outer surface 252*a*, 252*b* and the inner surface 254*a*, 254*b* may converge with each other in the lengthwise direction from the first end 244*a*, 244*b* to the terminal end 246*a*, 246*b*. Additionally or alternatively, the outer surface 252*a*, 252*b* and the inner surface 254*a*, 254*b* may converge with each other in the height direction from the base 248*a*, 248*b* to the distal edge 250*a*, 250*b*. Accordingly, widths of the anterior blades 230*a*, 230*b* taper along the length direction and the height direction. As shown, the outer surface 252*a*, 252*b* and the inner surface 254*a*, 254*b* intersect with each other at the distal edge 250*a*, 250*b*, such that the distal edge 250*a*, 250*b* forms a sharp edge extending continuously from the first end 244*a*, 244*b* to the terminal end 246*a*, 246*b*.

Referring still to FIG. 6A, each of the posterior blades 232*a*, 232*b* includes a first end 256*a*, 256*b* attached to an posterior end of the central stud 228*a*, 228*b* and a terminal end 258*a*, 258*b* disposed between the central stud 228*a*, 228*b* and the posterior end 20 in the forefoot region 12. Accordingly, a length of each of the posterior blades 232*a*, 232*b* extends from the first end 256*a*, 256*b* at the central stud 228, and towards the posterior end 20 of the article of footwear 10 to the terminal end 258*a*, 258*b*.

A height of the posterior blades 232*a*, 232*b* extends from a base 260*a*, 260*b* attached to the bottom surface 208 of the forefoot plate 202 to a distal edge 262*a*, 262*b* facing away from the bottom surface 208. As shown in FIGS. 2 and 3, the heights of the posterior blades 232*a*, 232*b* taper along the lengthwise direction of each of the posterior blades 232*a*, 232*b*, from the first end 256*a*, 256*b* to the terminal end 258*a*, 258*b*. In some examples, the distal edge 262*a*, 262*b* may have a concave profile from the first end 256*a*, 256*b* to the terminal end 258*a*, 258*b*.

In the illustrated example, each of the posterior blades 232*a*, 232*b* includes an outer surface 264*a*, 264*b* facing an outer periphery of the article of footwear 10, and an inner surface 266*a*, 266*b* formed on an opposite side of the posterior blade 232*a*, 232*b* from the outer surface 264*a*, 264*b*. The outer surface 264*a*, 264*b* and the inner surface 266*a*, 266*b* may converge with each other in the lengthwise direction from the first end 256*a*, 256*b* to the terminal end 258*a*, 258*b*. Additionally or alternatively, the outer surface 264*a*, 264*b* and the inner surface 266*a*, 266*b* may converge with each other in the height direction from the base 260*a*, 260*b* to the distal edge 262*a*, 262*b*. Accordingly, widths of the posterior blades 232*a*, 232*b* may taper along the length direction and the height direction. As shown, the outer surface 264*a*, 264*b* and the inner surface 266*a*, 266*b* intersect with each other at the distal edge 262*a*, 262*b*, such that the distal edge 262*a*, 262*b* forms a sharp, knife-like edge extending continuously from the first end 256*a*, 256*b* to the terminal end 258*a*, 258*b*.

The outer surfaces 238*a*, 252*a*, 264*a* of the lateral peripheral cleat 222*a* are continuously formed with each other, and cooperate to form a substantially continuous convex surface facing the lateral portion 210*a* of the outer peripheral side surface 210. Likewise, the outer surfaces 238*b*, 252*b*, 264*b* of the medial peripheral cleat 222*b* are continuously formed with each other, and cooperate to form a substantially continuous convex surface facing the medial portion 210*b* of the peripheral side surface 210.

The inner surfaces 254*a*, 254*b* of the anterior blades 230*a*, 230*b* intersect the inner surfaces 240*a*, 240*b* of the respective central studs 228*a*, 228*b* to form substantially continuous convex surfaces at anterior portions of the peripheral cleats 222*a*, 222*b*. Similarly, the inner surfaces 264*a*, 264*b* of the posterior blades 232*a*, 232*b* intersect the posterior surfaces 242*a*, 242*b* of the respective central studs 228*a*, 228*b* to form substantially continuous convex surfaces at posterior portions of the peripheral cleats 222*a*, 222*b*.

On the lateral peripheral cleat 222*a*, the intersection between the inner surface 254*a* of the anterior blade 230*a* and the inner surface 240*a* of the central stud 228*a* has a first radius $R_{230a}$, while the intersection between the inner surface 266*a* of the posterior blade 232*a* and the posterior surface 242*a* of the central stud 228*a* has a second radius $R_{232a}$. Optionally, the first radius $R_{230a}$ may be larger than the second radius $R_{232}a$ such that a transition from the inner surface 254*a* of the anterior blade 230*a* and the inner surface 240*a* of the central stud 228*a* is more gradual than the transition from the inner surface 266*a* of the posterior blade 232*a* and the posterior surface 242*a* of the central stud 228*a*.

On the lateral peripheral cleat 222*b*, the intersection between the inner surface 254*b* of the anterior blade 230*b* and the inner surface 240*b* of the central stud 228*b* has a first radius $R_{230b}$, while the intersection between the inner surface 266*b* of the posterior blade 232*b* and the posterior surface 242*b* of the central stud 228*b* has a second radius $R_{232b}$. Optionally, the first radius $R_{230b}$ may be larger than the second radius $R_{232b}$ such that a transition from the inner surface 254*b* of the anterior blade 230*b* and the inner surface 240*b* of the central stud 228*b* is more gradual than the transition from the inner surface 266*b* of the posterior blade 232*b* and the posterior surface 242*b* of the central stud 228*b*.

As shown in FIG. 6A, the distal edges 250*a*, 262*a* of the lateral peripheral cleat 222*a* extend substantially parallel to the curvature of the lateral portion 210*a* of the peripheral side surface. The distal edges 250*b*, 262*b* of the medial peripheral cleat 222*b* may extend at an oblique angle relative to the peripheral side surface 210. For example, the distal edges 250*b*, 262*b* of the anterior blade 230*b* and the posterior blade 232*b* may diverge from the peripheral side surface 210 along the lengthwise direction from the first end 244*b*, 256*b* to the terminal end 246*b*, 258*b*.

Figure 1A:
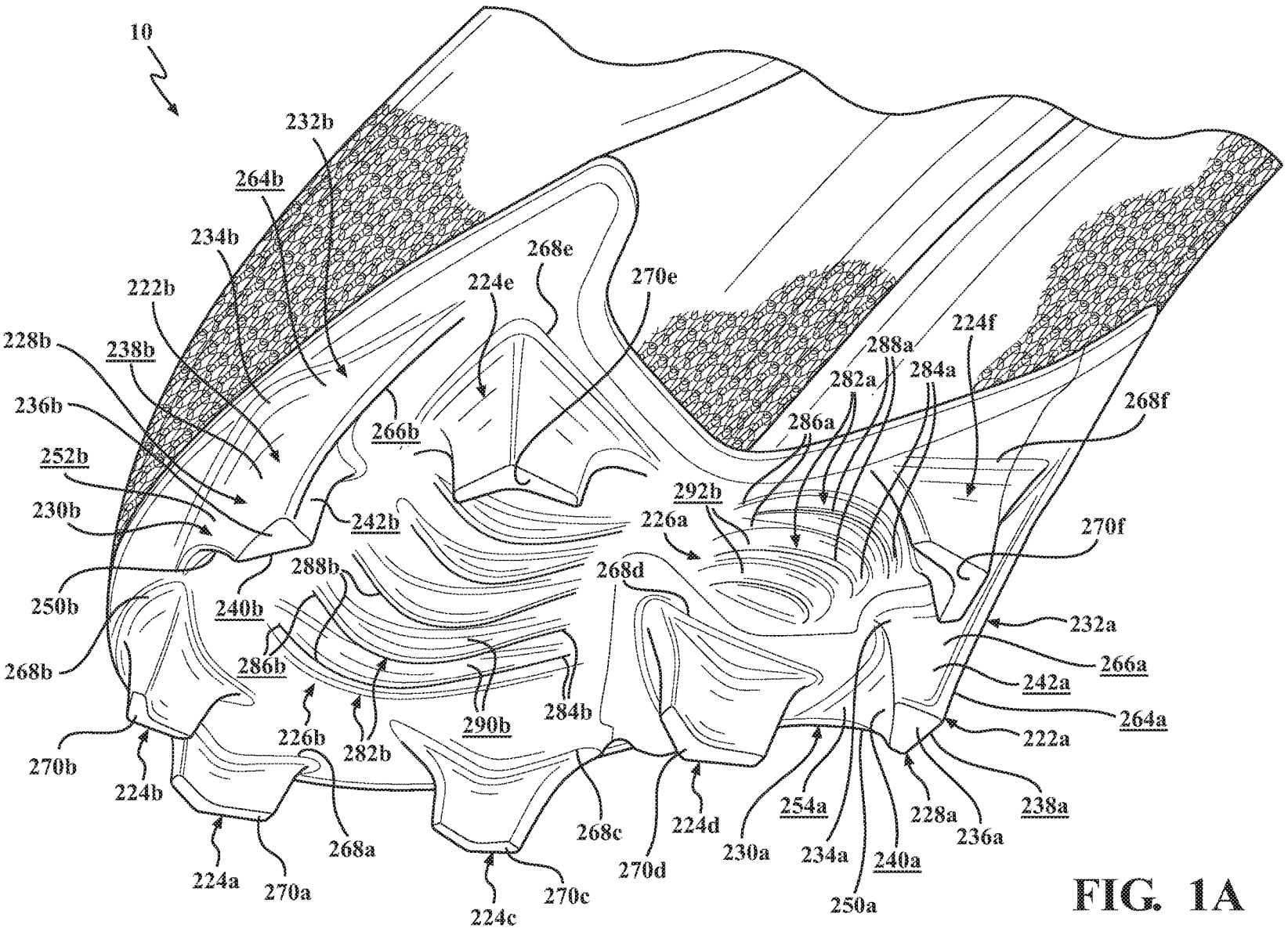
FIG. 1A is an enlarged bottom perspective view of the article of footwear of FIG. 1, taken at area 1A in FIG. 1.

In addition to the peripheral cleats 222*a*, 222*b*, the forefoot plate 202 includes one or more directional cleats 224*a*-224*f* Each of the directional cleats 224*a*-224*f* extends from a base 268*a*-268*f* attached to the bottom surface 208 of the forefoot plate 202 to a distal tip 270*a*-270*f* facing away from the bottom surface 208, as best shown in FIG. 1A. In some examples, the distal tip 270*a*-270*f* is substantially planar.

Each of the directional cleats 224*a*-224*f* has a generally chevron-shaped configuration including a first leg 272*a*-272*f* and a second leg 274*a*-274*f* extending in opposite directions from a central portion 276*a*-276*f* to respective distal ends. However, the size and/or shape of one or more of the directional cleats 224*a*-224*f* may transition along the direction from the base 268*a*-268*f* to the distal tip 270*a*-270*f* For example, the directional cleats 224*a*-224*f* may be tapered from the base 268*a*-268*f* to the distal tip 270*a*-270*f* Additionally or alternatively, the cross-sectional shape of one or more of the directional cleats 224*a*-224*f* may transition from a chevron having rounded sides at the base 268*a*-268*f* to a chevron having straight sides at the distal tip 270*a*-270*f*.

As shown, the first leg 272*a*-272*f* and the second leg 274*a*-274*f* cooperate to define a convex or pointed leading face 278*a*-278*f* and a concave or cupped trailing face 280*a*-280*f* formed on an opposite side of the directional cleat 224*a*-224*f* from the leading face 278*a*-278*f*. In some examples, the leading face 278*a*-278*f* may include a leading edge formed along the central portion 276*a*-276*f* from the base 268*a*-268*f* to the tip 270*a*-270*f*.

With continued reference to FIG. 6A, the forefoot plate 202 includes a first directional cleat 224*a* located adjacent to the anterior end 18 of the sole structure 200, with the leading face 278*a* facing towards the anterior end 18. A second directional cleat 224*b* is located in the toe portion 12T adjacent to the medial portion 210*b* of the peripheral side surface 210. A third directional cleat 224*c* is located in the toe portion 12T, laterally across from the second directional cleat 224*b* and adjacent to the lateral portion 210*a* of the peripheral side surface 210. More particularly, the second directional cleat 224*b* is located adjacent to and forward of (i.e., towards the anterior end 18) the notch 218, with the leading face 278*b* oriented forward and towards the lateral side 22. A fourth directional cleat 224*d* is located in the toe portion 12T on the lateral side 22, adjacent to the anterior blade 230*a* of the lateral peripheral cleat 222*a*. The leading face 278*d* of the fourth directional cleat 224*d* is oriented towards the anterior end 18.

In addition to the substantially forward-facing directional cleats 224*a*-224*d* described above, the forefoot plate may include fifth and sixth directional cleats 224*e*, 224*f* located in the ball portion 12B Particularly, the fifth directional cleat 224*e* is disposed in the ball portion 12B on the medial side 24 of the forefoot plate 202, adjacent to the posterior blade 232*b* of the medial peripheral cleat 222*b*. Here, the leading face 278*e* of the fifth directional cleat 224*e* is oriented rearward (i.e., towards the posterior end 20) and towards the medial side 24. The sixth directional cleat 224*f* is positioned on the lateral side of the ball portion 12B, adjacent to the posterior blade 232*a* of the lateral peripheral cleat 222*a*. Here, the leading face 278*f* of the sixth directional cleat 224*f* is oriented rearward and towards the lateral portion 210*a* of the peripheral side surface 210.

The forefoot plate 202 may also include one or more serrated regions 226*a*, 226*b* formed on an interior portion of the bottom surface 208. Each of the serrated regions 226*a*, 226*b* includes a plurality of elongate ribs 282*a*, 282*b* arranged in series along a direction of the longitudinal axis $A_{10}$. A length of each of the ribs 282*a*, 282*b* extends continuously from a first end 284*a*, 284*b* to a second end 286*a*, 286*b*, while a height of each of the ribs 282*a*, 282*b* extends from the bottom surface 208 of the forefoot plate to a distal edge 288*a*, 288*b*. In some examples, the height of each of the ribs 282*a*, 282*b* tapers along the length from a central portion to at least one of the first end 284*a*, 284*b* and the second end 286*a*, 286*b*, whereby a height of each rib 282*a*, 282*b* is greater in the middle. Particularly, the height of the ribs 282*a*, 282*b* may taper continuously to each end 284*a*, 284*b*, 286*a*, 286*b* so that the distal edge 288*a*, 288*b* intersects the bottom surface 208 of the forefoot plate 202.

Optionally, the length of each of the ribs 282*a*, 282*b* may extend along an arcuate path and include a concave inner surface 290*a*, 290*b* and a convex outer surface 292*a*, 292*b*. Here, adjacent ones of the ribs 282*a*, 282*b* may be substantially parallel to provide a series of arcuate ribs 282*a*, 282*b* arranged along the bottom surface 208. Optionally, lengths of successive ones of the ribs 282*a*, 282*b* may progressively increase from a first end (facing the concave inner surfaces) of the serrated region 226*a*, 226*b* to a second end (facing the convex outer surfaces) of the serrated region 226*a*, 226*b*. Accordingly, lengths of ribs 282*a*, 282*b* closer to the first end of the serrated region 226*a*, 226*b* will be shorter than ribs 282*a*, 282*b* closer to the second end of the serrated region 226*a*, 226*b*. Put another way, the serrated regions 226*a*, 226*b* may be described as having an overall width that tapers along the direction from the first end to the second end, whereby the lengths of the ribs 282*a*, 282*b* become successively shorter.

In the illustrated example, a first serrated region 226*a* is positioned on the lateral side 22 of the forefoot plate 202 in the ball portion 12B. As best shown in FIG. 6A, the first serrated region 226*a* is positioned adjacent to the trailing face 280*f* of the sixth directional cleat 224*f* and an inside edge of the central stud 228*a* of the lateral peripheral cleat 222*a*. The first serrated region 226*a* is also disposed between the trailing face 280*f* of the sixth directional cleat 224*f* and the trailing face 280*d* of the fourth directional cleat 224*d*. Here, the concave inner surfaces 290*a* of the ribs 282*a* face the anterior end of the forefoot plate 202. Accordingly, an overall width (i.e. lengths of the ribs 282*a*) of the first serrated region 226*a* tapers along the direction from the posterior end 20 to the anterior end 18.

A second serrated region 226*b* is positioned on the medial side 24 of the forefoot plate 202 and extends from a first end in the ball portion 12B to a second end in the toe portion 12T. Here, the first end is disposed adjacent to the trailing face 280*e* of the fifth directional traction element 224*e* and the second end is adjacent to the second directional traction element 224*b* and the third directional traction element 224*c*. Accordingly, an overall width (i.e. lengths of the ribs 282*b*) of the second serrated region 226*b* tapers along the direction from the anterior end 18 to the posterior end 20.

The heel plate 204 of the sole structure 200 is located in the heel region 16 adjacent to the posterior end 20. The peripheral side surface 216 of the heel plate 204 may define a notch 294 in an anterior end of the heel plate 204, which divides the anterior end of the heel plate 204 into lateral and medial lobes 296*a*, 296*b*. The notch 294 tapers in width from the anterior end of the heel plate 204 to a central portion of the heel plate 204.

The heel plate 204 includes a central spine 298 extending from a first end 300 at the notch 294 to a second end 302 at the posterior end 20 of the article of footwear 10 along the longitudinal axis $A_{10}$. The spine 298 may include a cleat 304 formed in an intermediate portion thereof. In some examples, the cleat 304 is formed where a first portion 298*a* of the spine 298 that extends longitudinally along the bottom surface 214 of the heel plate 204 intersects a second portion 298*b* of the spine 298 that extends vertically along the posterior end 20 of the heel plate 204. Here, a thickness of the first portion 298*a* continuously increases along a direction from the first end 300 of the spine 298 and a thickness of the second portion 298*b* continuously increases along a direction from the second end 302 of the spine 298. Accordingly, the cleat 304 is formed at the thickest portion of the spine 298, where the first portion 298*a* and the second portion 298*b* converge.

Figure 1B:
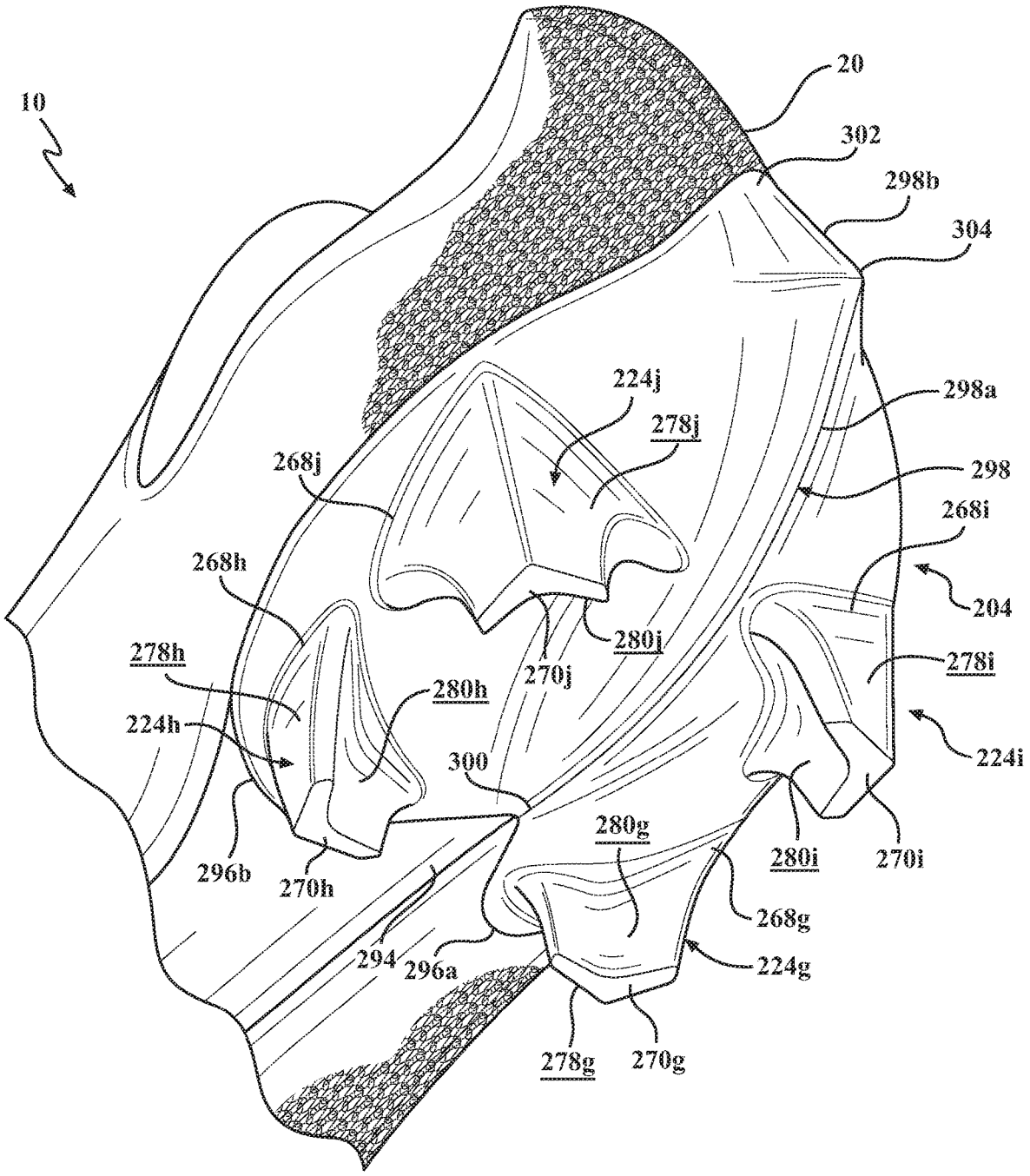
FIG. 1B is an enlarged bottom perspective view of the article of footwear of FIG. 1, taken at area 1B in FIG. 1.

As with the forefoot plate 202, the heel plate 204 includes one or more directional cleats 224*g*-224*j*. Each of the directional cleats 224*g*-224*j* extends from a base 268*g*-268*j* attached to the bottom surface 208 of the forefoot plate 202 to a distal tip 270*g*-270*j* facing away from the bottom surface 208, as best shown in FIG. 1B. In some examples, the distal tip 270*g*-270*j* is substantially planar.

Each of the directional cleats 224*g*-224*j* has a generally chevron-shaped configuration including a first leg 272*g*-272*j* and a second leg 274*g*-274*j* extending in opposite directions from a central portion 276*g*-276*j* to respective distal ends. However, the size and/or shape of one or more of the directional cleats 224*g*-224*j* may transition along the direction from the base 268*g*-268*j* to the distal tip 270*g*-270*j*. For example, the directional cleats 224*g*-224*j* may be tapered from the base 268*g*-268*j* to the distal tip 270*g*-270*j*. Additionally or alternatively, the cross-sectional shape of one or more of the directional cleats 224*g*-224*j* may transition from a chevron having rounded sides at the base 268*g*-268*j* to a chevron having straight sides at the distal tip 270*g*-270*j*.

As shown, the first leg 272*g*-272*j* and the second leg 274*g*-274*j* cooperate to define a convex or pointed leading face 278*g*-278*j* and a concave or cupped trailing face 280*g*-280*j* formed on an opposite side of the directional cleat 224*g*-224*j* from the leading face 278*g*-278*j*. In some examples, the leading face 278*g*-278*j* may include a leading edge formed along the central portion 276*a*-276*j* from the base 268*g*-268*j* to the tip 270*g*-270*j*.

Figure 6B:
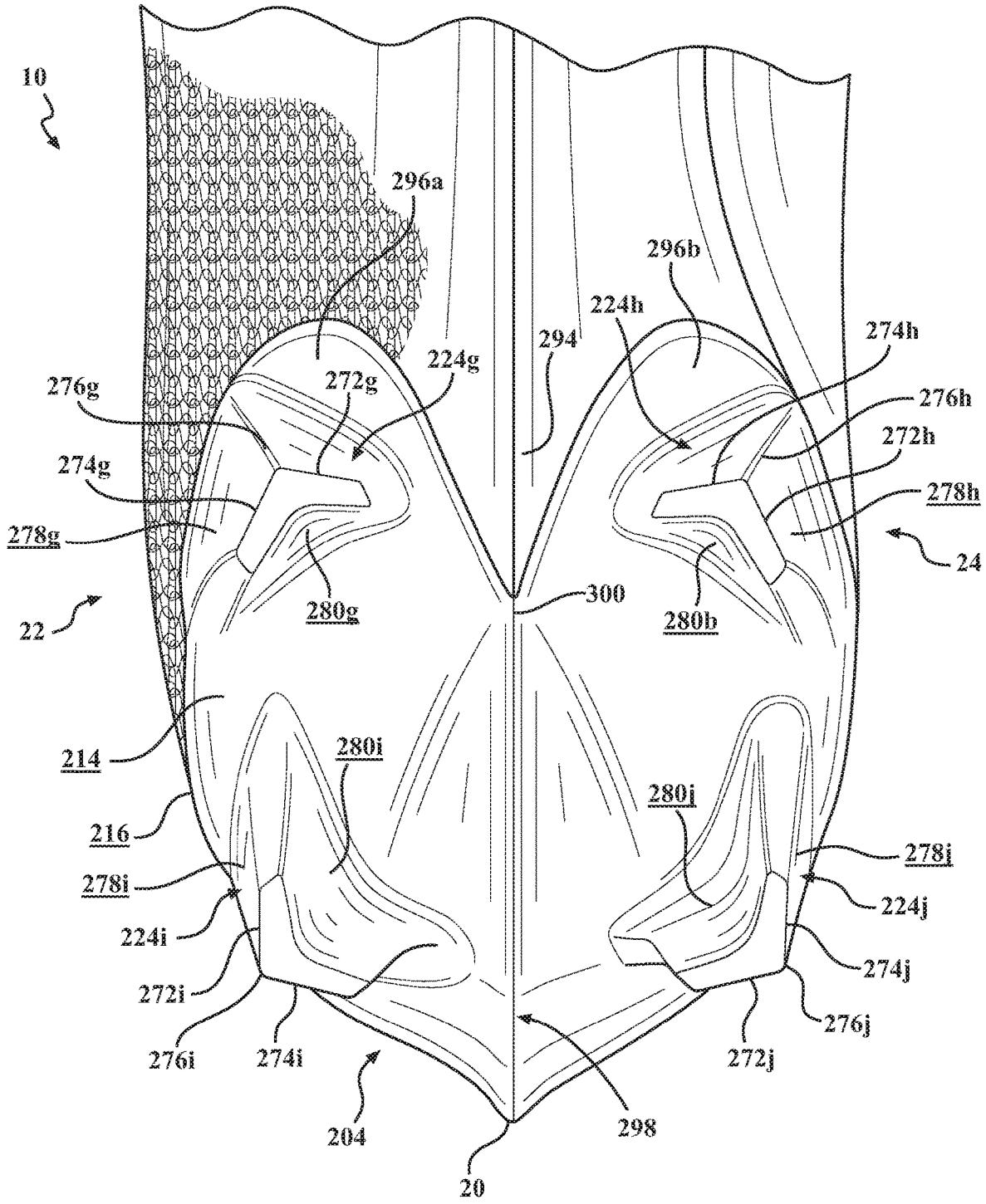
FIG. 6B is an enlarged bottom plan view of the article of footwear of FIG. 1, taken at area 6B of FIG. 6.

As best shown in FIG. 6B, the heel plate 204 includes a first pair of forward facing directional cleats 224*g*, 224*h*, including a seventh directional cleat 224*g* located on the lateral lobe 296*a* and an eighth directional cleat 224*h* located on the medial lobe 296*b*. Accordingly, the forward facing directional cleats 224*g*, 224*h* are disposed on opposite sides of the notch 294. The leading face 278*g* of the seventh directional cleat 224*g* is oriented at an oblique angle relative to the longitudinal axis $A_{10}$ such that the central portion 276*g* points towards the lateral side 22 and the anterior end 18 of the article of footwear 10. The leading face 278*h* of the eighth directional cleat 224*h* is oriented at an oblique angle relative to the longitudinal axis $A_{10}$, in an opposite direction of the seventh directional cleat 224*g*. Accordingly, the central portion 276*h* of the eighth directional cleat 224*h* points towards the medial side 24 and the anterior end 18 of the article of footwear 10.

The heel plate 204 also includes a pair of rearward facing directional cleats 224*i*, 224*j*, including a ninth directional cleat 224*i* and a tenth directional cleat 224*j*. The ninth directional cleat 224*i* is located adjacent to the peripheral side surface 216 on the lateral side 22 at the posterior end 20. The leading face 278*i* of the ninth directional cleat 224*i* is oriented at an oblique angle relative to the longitudinal axis $A_{10}$ such that the central portion 276*i* points towards the lateral side 22 and the posterior end 20 of the article of footwear 10. The tenth directional cleat 224*j* is located adjacent to the peripheral side surface 216 on the medial side 24 at the posterior end 20. The leading face 278*j* of the tenth directional cleat 224*j* is oriented at an oblique angle relative to the longitudinal axis $A_{10}$ such that the central portion 276*j* points towards the medial side 24 and the posterior end 20 of the article of footwear 10.

As shown, the directional cleats 224*g*-224*j* of the heel plate 204 are radially arranged about a central portion of the heel plate 204 such that the concave or cupped trailing faces 280*g*-280*j* of the directional cleats 224*g*-224*j* face each other. Accordingly, the trailing faces 280*g*-280*j* cooperate to define a rotational track in the heel region 16 of the article of footwear, whereby the trailing faces engage the ground surface and follow a substantially similar rotational path as the user rotates the foot about the heel portion 16.

Along with allowing rotation in the heel region 16, the chevron-shaped directional cleats 224*g*-224*j* provide traction in the longitudinal and lateral directions. Particularly, the first legs 272*g*-272*j* and the second legs 274*g*-274*j* form ground engaging surfaces that are transverse to the forces applied when moving in the longitudinal and lateral directions, thereby preventing slippage of the heel plate 204 relative to the ground surface.

The following Clauses provide an exemplary configuration for an article of footwear described above.

Clause 1: An article of footwear comprising an upper having a bottom surface and a first plate attached to the bottom surface of the upper in a forefoot region. The first plate includes a lateral peripheral cleat disposed adjacent to a first outward-most portion of the upper on a lateral side and a medial peripheral cleat disposed adjacent to a second outward-most portion of the upper on a medial side, the medial peripheral cleat being disposed closer to an anterior end of the first plate than the lateral peripheral cleat.

Clause 2: The article of footwear of Clause 1, wherein the first outward-most portion of the upper and the second outward-most portion of the upper are aligned along a metatarsophalangeal axis.

Clause 3: The article of footwear of any of the preceding clauses, wherein each of the peripheral cleats includes a stud disposed at the respective outward-most portion of the upper, a first blade extending along a first longitudinal direction from an anterior end of the stud, and a second blade extending along a second longitudinal direction from a posterior end of the stud.

Clause 4: The article of footwear of Clause 3, wherein the stud includes an outward-facing surface disposed adjacent to a peripheral surface of the first plate.

Clause 5: The article of footwear of any of the preceding clauses, wherein the first plate includes one or more serrated regions.

Clause 6: The article of footwear of Clause 5, wherein the one or more serrated regions includes a first serrated region disposed on the lateral side of the first plate and a second serrated region disposed on the medial side of the first plate.

Clause 7: The article of footwear of Clause 5, wherein each of the one or more serrated regions includes a plurality of arcuate ribs.

Clause 8: The article of footwear of any of the preceding clauses, further comprising a second plate disposed in a heel region.

Clause 9: The article of footwear of any of the preceding clauses, wherein the first plate includes a plurality of directional cleats.

Clause 10: The article of footwear of Clause 9, wherein each of the directional cleats includes a first leg and a second leg.

Clause 11: An article of footwear comprising an upper having a bottom surface and a first plate attached to the bottom surface of the upper in a forefoot region. The first plate includes a first peripheral cleat disposed adjacent to a peripheral side surface on a lateral side and a second peripheral cleat disposed adjacent to the peripheral side surface on a medial side, each of the first peripheral cleat and the second peripheral cleat (i) including a central stud and at least one blade extending in a longitudinal direction along the peripheral side surface of the first plate and (ii) being offset from one another along a longitudinal axis of the first plate.

Clause 12: The article of footwear of Clause 11, wherein the central stud and the at least one blade of the first peripheral cleat cooperate to form a first continuous outer surface adjacent to the peripheral side surface on the lateral side, and the central stud and the at least one blade of the second peripheral cleat cooperate to form a second continuous outer surface adjacent to the peripheral side surface on the medial side.

Clause 13: The article of footwear of Clause 11, wherein the at least one blade includes a first blade extending along a first longitudinal direction from an anterior end of the central stud, and a second blade extending along a second longitudinal direction from a posterior end of the central stud.

Clause 14: The article of footwear of Clause 13, wherein the central stud includes an outward-facing surface disposed adjacent to a peripheral surface of the first plate.

Clause 15: The article of footwear of any of the preceding clauses, wherein the first plate includes one or more serrated regions.

Clause 16: The article of footwear of Clause 15, wherein the one or more serrated regions includes a first serrated region disposed on the lateral side of the first plate and a second serrated region disposed on the medial side of the first plate.

Clause 17: The article of footwear of Clause 15, wherein each of the one or more serrated regions includes a plurality of arcuate ribs.

Clause 18: The article of footwear of any of the preceding clauses, further comprising a second plate disposed in a heel region.

Clause 19: The article of footwear of any of the preceding clauses, wherein the first plate includes a plurality of directional cleats.

Clause 20: The article of footwear of Clause 19, wherein each of the directional cleats includes a first leg and a second leg.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

an upper having a bottom surface;

a first plate attached to the bottom surface of the upper in a forefoot region and including a lateral peripheral cleat disposed adjacent to a first outward-most portion of the upper on a lateral side and a medial peripheral cleat disposed adjacent to a second outward-most portion of the upper on a medial side, the medial peripheral cleat being disposed closer to an anterior end of the first plate than the lateral peripheral cleat, each of the peripheral cleats including a stud, including an inner surface, having a substantially triangular cross-sectional shape and a first blade, having an inner surface, extending along a first longitudinal direction from a first end attached to an anterior end of the stud toward a terminal end disposed between the stud and the anterior end, and a second blade, having an inner surface, extending along a second longitudinal direction from a first end attached to a posterior end of the stud toward a terminal end disposed between the stud and the posterior end, wherein outer surfaces of the stud, the first blade, and the second blade form a substantially continuous outer surface of the plate, and wherein an intersection between the inner surface of the stud and the inner surface of the first blade has a first radius of curvature, and an intersection between the inner surface of the stud and the inner surface of the second blade has a second radius of curvature different from the first radius of curvature; and a first serrated region disposed between the lateral peripheral cleat and the medial peripheral cleat and including a plurality of elongate first ribs extending from a bottom surface of the first plate, wherein each of the first ribs includes a central portion, a first end, and a second end opposite the first end, a height of each of the first ribs tapering from a tallest height at the central portion to shorter heights at the first end and at the second end.

2. The article of footwear of claim 1, wherein the first outward-most portion of the upper and the second outward-most portion of the upper are aligned along a metatarsophalangeal axis.

3. The article of footwear of claim 1, wherein each stud of the peripheral cleats is disposed at the respective outward-most portion of the upper, and wherein the stud includes an outward-facing surface disposed adjacent to a peripheral surface of the first plate.

4. The article of footwear of claim 1, wherein first ribs of the plurality of elongate first ribs include an arcuate shape.

5. The article of footwear of claim 1, wherein first ribs of the plurality of elongate first ribs include a concave surface formed on a first side of each first rib and a convex surface formed on an opposite side of each first rib.

6. The article of footwear of claim 5, wherein the concave surface of each first rib faces the anterior end of the first plate.

7. The article of footwear of claim 5, wherein the concave surface of each first rib faces a posterior end of the first plate.

8. The article of footwear of claim 1, further comprising:

a second serrated region disposed between the lateral peripheral cleat and the medial peripheral cleat and including a plurality of elongate second ribs extending from the bottom surface of the first plate, wherein at least one first rib of the plurality of elongate first ribs includes a first concave surface and at least one second rib of the plurality of elongate second ribs includes a second concave surface, the first concave surface facing the anterior end of the first plate and the second concave surface facing a posterior end of the first plate.

9. An article of footwear comprising:

an upper having a bottom surface;

a first plate attached to the bottom surface of the upper in a forefoot region and including a first peripheral cleat disposed adjacent to a peripheral side surface of the first plate on a lateral side and a second peripheral cleat disposed adjacent to a peripheral side surface on a medial side, each of the first peripheral cleat and the second peripheral cleat (i) including a central stud having a substantially triangular cross-sectional shape and at least one blade having a first end attached to an anterior end of the stud and a terminal end disposed between the central stud and a terminal end of the article of footwear, wherein the at least one blade has a height that tapers downward from the first end to the terminal end, the at least one blade extending in a longitudinal direction along the peripheral side surface of the first plate and (ii) being offset from one another along a longitudinal axis of the first plate; and a first serrated region disposed between the first peripheral cleat and the second peripheral cleat and including a plurality of elongate first ribs extending from a bottom surface of the first plate, wherein each of the first ribs includes a central portion, a first end, and a second end opposite the first end, a height of each of the first ribs tapering from a tallest height at the central portion to shorter heights at the first end and at the second end.

10. The article of footwear of claim 9, wherein the central stud and the at least one blade of the first peripheral cleat cooperate to form a first continuous outer surface adjacent to the peripheral side surface on the lateral side, and the central stud and the at least one blade of the second peripheral cleat cooperate to form a second continuous outer surface adjacent to the peripheral side surface on the medial side.

11. The article of footwear of claim 9, wherein the at least one blade includes a first blade extending along a first longitudinal direction from an anterior end of the central stud, and a second blade extending along a second longitudinal direction from a posterior end of the central stud, and wherein the central stud includes an outward-facing surface disposed adjacent to a peripheral surface of the first plate.

12. The article of footwear of claim 9, wherein the first ribs of the plurality of elongate first ribs include an arcuate shape.

13. The article of footwear of claim 9, wherein the first ribs of the plurality of elongate first ribs include a concave surface formed on a first side of each first rib and a convex surface formed on an opposite side of each first rib.

14. The article of footwear of claim 13, wherein the concave surface of each first rib faces an anterior end of the first plate.

15. The article of footwear of claim 13, wherein the concave surface of each first rib faces a posterior end of the first plate.

16. The article of footwear of claim 9, further comprising:

a second serrated region disposed between the first peripheral cleat and the second peripheral cleat and including a plurality of elongate second ribs extending from the bottom surface of the first plate, and wherein at least one first rib of the plurality of elongate first ribs includes a first surface that is concave when viewed from an anterior end of the first plate and at least one second rib of the plurality of elongate second ribs includes a second surface that is convex when viewed from the anterior end of the first plate.

17. The article of footwear of claim 1, wherein (i) the first blade and the second blade of each of the peripheral cleats includes a height that tapers downward from the first end to the terminal end, the first blade and the second blade extending in a longitudinal direction along the peripheral side surface of the first plate such that the first blade, the second blade, and the stud form a continuous curved edge along the peripheral side surface and (ii) each of the peripheral cleats are offset from one another along a longitudinal axis of the first plate.

18. The article of footwear of claim 17, wherein a portion of the stud forms a portion of an outer peripheral surface of the article of footwear, wherein a first gap is disposed between the first blade and the outer peripheral surface, and a second gap is disposed between the second blade and the outer peripheral surface.

19. An article of footwear comprising:

an upper having a bottom surface; and a first plate, including a first surface and a second surface, attached to the bottom surface of the upper by the first surface in a forefoot region and including a lateral peripheral cleat disposed adjacent to a first outwardmost portion of the upper on a lateral side and a medial peripheral cleat disposed adjacent to a second outwardmost portion of the upper on a medial side, the medial peripheral cleat being disposed closer to an anterior end of the first plate than the lateral peripheral cleat, each of the peripheral cleats including:

a first serrated region disposed between the first peripheral cleat and the second peripheral cleat and including a plurality of elongate first ribs extending from a bottom surface of the first plate, wherein each of the first ribs includes a central portion, a first end, and a second end opposite the first end, a height of each of the first ribs tapering from a tallest height at the central portion to shorter heights at the first end and at the second end;

a stud, the stud including a first end attached to the second surface of the first plate and including a second end disposed apart from the first end and facing away from the bottom surface, forming a portion of an outer peripheral surface of the article of footwear, wherein a width of the stud tapers from a largest width at the first end to a smallest width at the second end;

a first blade extending along a first longitudinal direction from an anterior end of the stud; and a second blade extending along a second longitudinal direction from a posterior end of the stud, wherein each of the stud, the first blade, and the second blade includes an outer surface forming a continuous convex surface, and wherein a first gap is disposed between the first blade and the outer peripheral surface, and a second gap is disposed between the second blade and the outer peripheral surface.

20. The article of footwear of claim 17, wherein a portion of the stud forms a portion of an outer peripheral surface of the article of footwear such that a gap is formed between the first blade and the second blade, and the outer peripheral surface of the article of footwear.

* * * * *